US010384921B2

(12) United States Patent
Peirsman et al.

(10) Patent No.: US 10,384,921 B2
(45) Date of Patent: Aug. 20, 2019

(54) METHOD OF DISPENSING A MALT-BASED BEVERAGE, AS WELL AS DEVICE FOR DISPENSING A MALT-BASED BEVERAGE

(71) Applicant: Anheuser-Busch InBev S.A., Brussels (BE)

(72) Inventors: Daniel Peirsman, Leuven (BE); Stijn Vandekerckhove, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 15/108,317

(22) PCT Filed: Dec. 19, 2014

(86) PCT No.: PCT/EP2014/078823
§ 371 (c)(1),
(2) Date: Jun. 26, 2016

(87) PCT Pub. No.: WO2015/097095
PCT Pub. Date: Jul. 2, 2015

(65) Prior Publication Data

US 2016/0325977 A1 Nov. 10, 2016

(30) Foreign Application Priority Data

Dec. 27, 2013 (EP) ..... 13199705

(51) Int. Cl.
*B67D 1/00* (2006.01)
*B67D 1/14* (2006.01)

(52) U.S. Cl.
CPC ..... *B67D 1/0021* (2013.01); *B67D 1/0077* (2013.01); *B67D 1/0078* (2013.01); *B67D 1/1405* (2013.01); *B67D 2210/00125* (2013.01)

(58) Field of Classification Search
CPC ..... B67D 1/1405; B67D 1/0077; B67D 2210/00125
See application file for complete search history.

(56) References Cited

U.S. PATENT DOCUMENTS 3,386,261 A * 6/1968 Cornelius ..... B67D 1/0021 62/339
2003/0161923 A1* 8/2003 Holland ..... B67D 1/0054 426/524

FOREIGN PATENT DOCUMENTS

| | | |
|---|---|---|
| DE | 1757283 | 8/1971 |
| FR | 2618308 | 1/1989 |
| GB | 2559 | 8/1906 |
| GB | 146499 | 8/1921 |
| GB | 2160593 | 12/1985 |
| GB | 2340415 | 2/2000 |

* cited by examiner

*Primary Examiner* — Donnell A Long
(74) *Attorney, Agent, or Firm* — Levy & Grandinetti

(57) ABSTRACT

A method of dispensing a malt-based beverage dispenses into a receptacle ready for consumption and for use in an on-trade or off-trade environment. The method has the following steps. The step of composing a first component of the dispensed beverage is performed during dispensing by mixing a liquid with carbon dioxide and/or nitrogen. The step of adding the first component to at least a second beverage component so as to form the dispensed beverage is performed. The carbon dioxide and/or nitrogen is scented.

9 Claims, 2 Drawing Sheets

METHOD OF DISPENSING A MALT-BASED BEVERAGE, AS WELL AS DEVICE FOR DISPENSING A MALT-BASED BEVERAGE

The present invention relates to a method of dispensing a malt-based beverage.

A malt-based beverage can for example be a beer, but according to the invention also mixtures comprising a malt-based component and any other beverage or drinkable liquid can be a malt-based beverage.

More in particular the present invention relates to a method of dispensing a malt-based beverage into a receptacle ready for consumption and for use in an on-trade or off-trade environment.

By an on-trade environment is understood any environment wherein the dispensed beverage is consumed immediately, such as a bar, a pub, a club, a restaurant and so on.

The receptacles used in such on-trade environments are typically a glass or an open bottle.

By an off-trade environment is understood any location wherein the dispensed beverage is available for direct consumption, but is not consumed at that place, such as for example in a supermarket, a corner shop, a retailer, a wholesaler, etc.

The receptacles used in such off-trade environments are typically closed bottles, cans, boxes, plastic bags and so on.

According to the state of the art a lot of methods exist for dispensing a malt-based beverage.

In some of these known methods for dispensing a malt-based beverage, the malt-based beverage is stored in a concentrated form or, in other words, as a concentrate.

Such a concentrate is typically obtained by decreasing the water content in the original malt-based beverage.

Hereby, the concentrate still contains the components of the malt-based beverage which are important for the taste of the beverage, albeit in a very concentrated form.

In these known methods the concentrate is stored until it is needed for dispensing the beverage.

At the moment of dispensing the malt-based beverage, the concentrate is diluted so to reconstitute again a drinkable malt-based beverage with a normal taste.

Depending on whether the concentrate is a flat concentrate or a carbonated concentrate, it is usually diluted by mixing it with carbonated water or flat water respectively.

A first advantage of using a concentrate instead of the original malt-based beverage is that its volume is much reduced so that the space needed for storing the concentrate is much smaller compared to the volume to be stored when no concentrate is used.

Furthermore, water needed for the dilution of the concentrate is normally available from a tap at the place of dispensing the malt-based beverage.

An even more important advantage of reconstituting the malt-based beverage at the place of dispensing is the fact that transport costs are very much reduced.

Indeed, if only the concentrate needs to be transported to a site of dispensing the malt-based beverage, a much smaller volume and thus weight needs to be transported compared to a case wherein the complete, non-concentrated beverage should have been transported to said site.

Nevertheless, a great disadvantage of reconstituting a malt-based beverage at the site of dispensing is that the taste of the final beverage is often very different from the taste of the original malt-based beverage.

One of the reasons for this difference in taste lies in the process of concentrating the original malt-based beverage.

During the concentrating process the temperature of the original malt-based beverage is often increased, which is sometimes harmful for the final taste of the reconstituted malt-based beverage.

Another reason for this difference in taste between the original beverage and the reconstituted beverage is that the water used in a brewery has often a much higher quality than the water used in a pub or at home.

Another disadvantage of these known methods of dispensing a malt-based beverage is that the taste of the reconstituted malt-based beverage is often different from site to site.

One of the reasons of this variation from site to site of the taste of the final beverage is that the diluent used, normally water, differs from place to place.

Often, when dispensing a malt-based beverage, it is preferred that the beverage is topped with foam or with a so-called beer head.

The constitution and taste of this foam obtained with the known methods for dispensing a malt-based beverage is often different dependent on the outside temperature or other factors which influence the foam forming, but which factors are completely not taken into consideration during dispensing with the known methods.

As a consequence, with the known methods for dispensing a malt-based beverage the quality and taste of the finally dispensed product is often rather random and very hard to control.

It is therefore an objective of this invention to overcome one or more of the above-mentioned drawbacks or possibly other non-mentioned drawbacks of the known methods for dispensing a malt-based beverage.

It is in particular an objective of the present invention to provide a method for dispensing a malt-based beverage comprising a technique for increasing the control on the taste of the beverage and/or the taste and constitution of foam on the beverage finally dispensed.

It is a further objective of the present invention to provide a method of dispensing a malt-based beverage with increased possibilities of enhancing the taste of the final beverage dispensed.

To this aim, the present invention proposes a method of dispensing a malt-based beverage into a receptacle ready for consumption and for use in an on-trade or off-trade environment, the method comprising the steps of:

- composing a first component of the dispensed beverage during dispensing by mixing a liquid with carbon dioxide and/or nitrogen;
- adding the first component to at least a second component so to form the dispensed beverage;

and the method being further characterized in that said carbon dioxide and/or nitrogen is scented.

A great advantage of such a method according to the invention is that by using scented carbon dioxide and/or scented nitrogen, the final taste or the constitution of the dispensed malt-based beverage or a part of it can be easily adapted by supplying the corresponding flavor in the carbon dioxide or nitrogen, or by adapting the dose of flavor in the scented carbon dioxide and/or scented nitrogen.

Such an adaptation of the taste or constitution of the finally dispensed beverage can for example be an adaptation in function of conditions present at the site of dispensing, so to allow for a supply of dispensed beverages with a constant quality and taste independent from these conditions.

On the other hand, a modification of the taste or constitution of the final beverage can for example be intended as a compensation for a loss of fresh taste due to storage of beverage components or due to the processing of a beverage component into a concentrate or the like.

In still another case, a modification of the taste or of the constitution of the finally dispensed beverage is simply intended for increasing the sensation of a consumer.

According to a preferred method of the invention the carbon dioxide and/or nitrogen is scented by a flavor comprising one or more of the following;

a fermented hop flavor;
a fruit flavor;
a herb flavor;
a spice flavor;
a confectionery flavor.

It is clear that with the above-mentioned flavors or still other flavors, all kinds of new tastes can be added to the finally dispensed beverage, opening a wide range of new possibilities for satisfying a customer.

A preferred embodiment of a method in accordance with the invention of dispensing a malt-based beverage comprises the steps of:

providing a liquid which is a diluent;
providing a source of scented carbon dioxide and/or scented nitrogen;
treating said diluent by guiding the scented carbon dioxide or scented nitrogen there through so to form the first component of the beverage;
providing a second component which is a malt-based beverage concentrate; and,
dispensing the treated diluent and the malt-based beverage concentrate in a receptacle thereby obtaining a beverage ready for consumption.

This preferred embodiment of a method in accordance with the invention allows for the reconstitution of a malt-based beverage based on a concentrate, wherein the disadvantages, such as a loss of taste and quality of the final beverage, known from the existing, similar dispensing methods are overcome in an efficient way by means of adding a flavor to the carbon dioxide or the nitrogen.

The water quality used for the reconstitution of a malt-based beverage can for example be improved by using flavored carbon dioxide or flavored nitrogen.

Indeed, the flavor or flavors in the carbon dioxide or nitrogen provide in a kind of means for conditioning the water during its carbonation, prior to adding the water to a malt-based beverage concentrate such as a beer concentrate.

As a consequence, potential differences in water quality between water used in a brewery and water used in a pub or home can be compensated, for example by choosing a corresponding type of flavors and/or a flavor concentration in the carbon dioxide or nitrogen.

Still another embodiment of a method in accordance with the invention comprises the steps of:

dispensing a liquid beverage in a receptacle so to provide the second component of the beverage; and,
adding subsequently a foam collar on top of said liquid beverage being the first component of the beverage, said foam collar being created by mixing a scented carbon dioxide and/or scented nitrogen with a liquid during foaming thereof.

This preferred embodiment of a method in accordance with the invention is particularly interesting for dispensing a malt-based beverage with a foam collar having a special taste or smell, so to increase the excitement experienced by a customer at the first contact with the dispensed beverage.

The present invention also relates to a device for dispensing a malt-based beverage into a receptacle ready for consumption and for use in an on-trade or off-trade environment.

Such a device in accordance with the invention comprises at least:

a source of scented carbon dioxide and/or scented nitrogen;
a source of a liquid;
first mixing means for mixing scented carbon dioxide and/or scented nitrogen supplied from the concerned source with liquid supplied from the liquid source into a first beverage component;
a source of a second beverage component; and,
dispensing means for adding the first beverage component to the second beverage component so to form a dispensed malt-based beverage.

It is clear that with such a device a method of the invention as here-before described can be executed and hence the device has the same advantages as described with respect to the methods of the invention.

With the intention of better showing the characteristics of the invention, hereafter, as examples without any limitative character, some embodiments of a method and device according to the invention for dispensing a malt-based beverage are described, with reference to the accompanying drawings, wherein.

Figure 1:
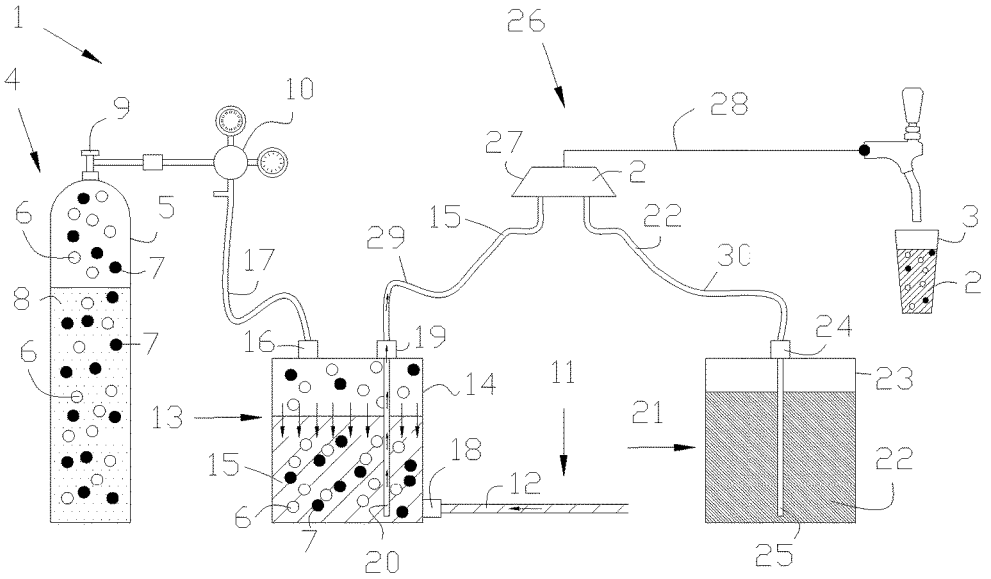
FIG. 1 is a schematic representation of a first embodiment of a device in accordance with the invention.

The first embodiment of a device 1 in accordance with the invention, represented in FIG. 1, is intended for dispensing a malt-based beverage 2 into a receptacle 3 ready for consumption and for use in an on-trade or off-trade environment.

The receptacle 3 is in this case a glass 3, but it could be any kind of receptacle suitable for being used in on-trade or off-trade environment.

The malt-based beverage 2 is typically a beer 2, but it can be any beverage comprising a malt-based component, such as for example a beer mixed with a soft drink or juice and so on.

The device 1 comprises first of all a source 4 of scented carbon dioxide or scented nitrogen or a mixture thereof.

This source 4 is in FIG. 1 represented as a bottle or cylinder 5, but it can be a tank or a $CO_2$ or $N_2$ utility line or the like.

In the case of FIG. 1 the bottle 5 is filled with carbon dioxide and/or nitrogen 6 which is mixed with one or more flavors 7.

These flavors 7 can be of any type and can for example be a fermented hop flavor, a fruit flavor (e.g. apple, strawberry, cherry, pineapple, mango, cranberry, lime, orange, raspberry), a spice flavor (e.g. cinnamon, cardamom, pepper, anise) or a confectionery flavor (e.g. chocolate, coffee, tea, tannin, bubble gum) and so on.

The dose or concentration of flavor 7 in the carbon dioxide and/or nitrogen 6 can be adapted according to the needs and for that purpose a dosing means could be provided (not represented in the figures).

The carbon dioxide and/or nitrogen 6 are under pressure liquefied and are therefore at least partly in liquidized form 8 in the cylinder or bottle 5.

The bottle 5 is provided with an outlet 9 for releasing the scented carbon dioxide and/or scented nitrogen 6 through a regulator set 10.

When scented carbon dioxide and/or scented nitrogen 6 is withdrawn from the bottle 5 pressure drops and gaseous scented carbon dioxide and/or scented nitrogen 6 is formed.

In some cases the flavors 7 in this gaseous scented carbon dioxide and/or scented nitrogen 6 are present in their gaseous form, while in other cases the flavors 7 can be small liquid droplets or fine solid particles which are suspended in the carbon dioxide-nitrogen gas 6 forming an aerosol.

The device 1 is furthermore provided with a source 11 of a liquid 12.

This source 11 is in FIG. 1 represented as supply line 11 for supplying water 12, but it can be any kind of source which is suitable for supplying the liquid 12.

The liquid 12 is typically a diluent such as flat water, but it can be a beer or a beer concentrate, preferably flat beer or a flat beer concentrate, or any other drinkable component such as a juice, a strong alcohol, a tea and so on.

The device 1 is also provided with a first mixing means 13 in the form of a cask 14 for mixing scented carbon dioxide and/or scented nitrogen supplied from the bottle 5 with liquid 12 supplied from the source or liquid line 11 so to form a first beverage component 15.

The cask 14 is at the top provided with an inlet 16 which is connected to the regulator set 10 and bottle 5 by means of a supply line 17 through which scented carbon dioxide and/or nitrogen is supplied to the cask 14.

On the other hand, the cask 14 is also provided with an inlet 18 near its bottom for supplying liquid 12 to the cask 14.

Furthermore, an outlet 19 is provided at the top of the cask 14.

On this outlet 19 a dip tube 20 is provided which hangs into the first beverage component 15 and through which the first beverage component 15 formed in the cask 14 is expelled under pressure provided by the scented carbon dioxide and/or nitrogen 6-7.

For mixing the scented carbon dioxide and or nitrogen 6-7 with the liquid 12, it can be forced through the liquid 12 or the mixing can take place purely by diffusion.

The first beverage component 15 is in this embodiment a carbonated liquid 15, the carbon dioxide and or nitrogen 6 used for the carbonation being scented with a flavor 7 or flavors 7.

Apart from giving another taste to the liquid 12, i.e. to the water 12 in this case; the scented carbon dioxide or nitrogen 6-7 can also have a more medical purpose, for example for keeping the first component formed free of bacteria;

For that purpose the carbon dioxide and/or nitrogen 6 can be scented with a germicide or bactericide.

The device 1 is furthermore provided with a source 21 for supplying a second beverage component 22

This source 21 is in the case of FIG. 1 a pressurized keg 23 comprising the second beverage component 22.

The second beverage component 22 is typically a flat beer or a flat beer concentrate, but it can be a diluent as well or even any other type of drinkable liquid.

The keg 23 has an outlet 24 provided with a dip tube 25 through which the second beverage component 22 can be expelled.

Finally, the device 1 comprises also dispensing means 26 for adding the first beverage component 15 to the second beverage component 22 so to form a dispensed malt-based beverage 2.

This dispensing means 26 are in the case of FIG. 1 formed by a mixing chamber 27 in which the first beverage component 15 and the second beverage component 22 are mixed prior to being dispensed through a tap line 28 into the glass 3.

First beverage component 15 is supplied to the mixing chamber 26 by means of outlet line 29 provided at the outlet 19 of the cask 14, while the second beverage component 22 is supplied to the mixing chamber 26 through supply line 30 provided at the outlet 24 of the source 21.

This first embodiment of a device 1 in accordance with the invention is practical in use for dispensing of a malt-based beverage 2 by applying a method in accordance with the invention.

Indeed, liquid diluent 12 is provided from supply line 11 and is mixed with scented carbon dioxide and/or scented nitrogen 6-7 provided from bottle 5 in cask 14 by guiding the scented carbon dioxide and/or scented nitrogen 6-7 through the liquid 12.

As a result a first beverage component 15 being in this case a carbonated water 15 scented with certain flavors 7 is formed.

From a source 21 a second beverage component 22, i.e. in this case a malt-based concentrate 22, is provided to a mixing chamber 27 which is added to the first component or carbonated water 15 for reconstituting a malt-based beverage 2 which is dispensed through tap line 28 into receptacle 3, ready for consumption.

It is clear that in the case discussed, the first beverage component 15 can be considered as a carbonated water which is conditioned by means of certain flavors 7, so to increase the quality of the carbonated water 15 and as a consequence improving the quality and taste of the finally dispensed beverage 2.

Figure 2:
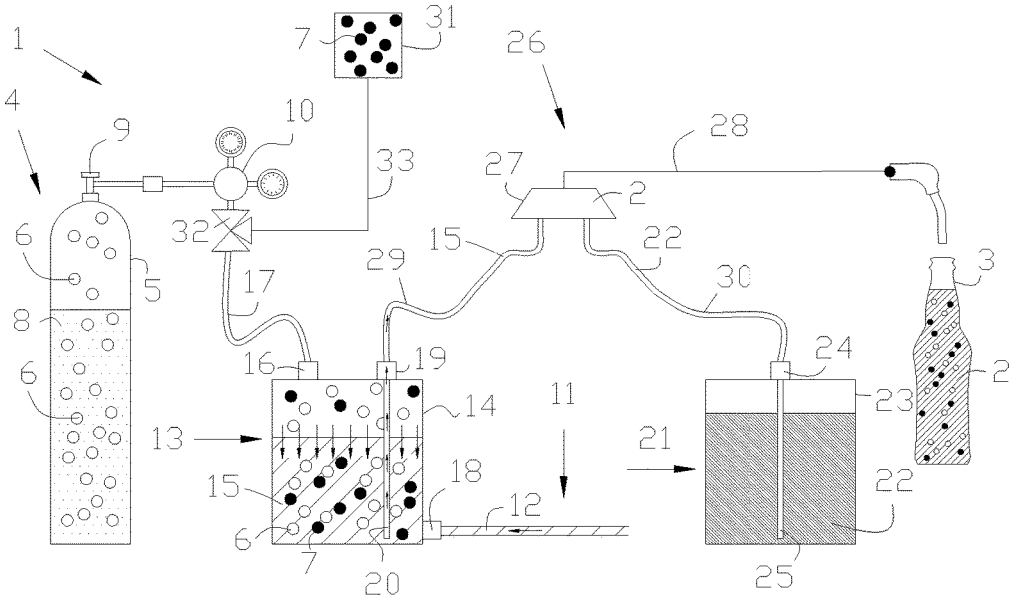
FIGS. 2 and 3 represent slightly adapted versions of the device represented in FIG. 1; and, FIG. 4 is a schematic representation of a fourth embodiment of a device in accordance with the invention.

FIG. 2 represents a second embodiment of a device 1 in accordance with the invention, which is different from the first embodiment in that the carbon dioxide and/or nitrogen 6 in the bottle 5 is not pre-mixed with flavor 7.

Instead a source 31 of flavor 7, i.e. in this case a bottle 31 of pressurized gaseous flavor 7, is provided as well as a second mixing means 32, which is in this case realized by a 3-way valve 32 through which carbon dioxide and/or nitrogen 6 supplied from source 4 is mixed by flavor 7 supplied through a supply line 33 from the flavor source 31.

It is clear that in this embodiment the concentration of flavor in the carbon dioxide and/or nitrogen can be easily adapted and that the bottle 31 can be easily replaced by another one, for example when it is empty or when there is a need for supplying another kind of flavor 7.

The receptacle 3 is in the case of FIG. 2 a bottle 3, for example a beer bottle 3 ready for sale in a shop and typically consumed at home.

Figure 3:
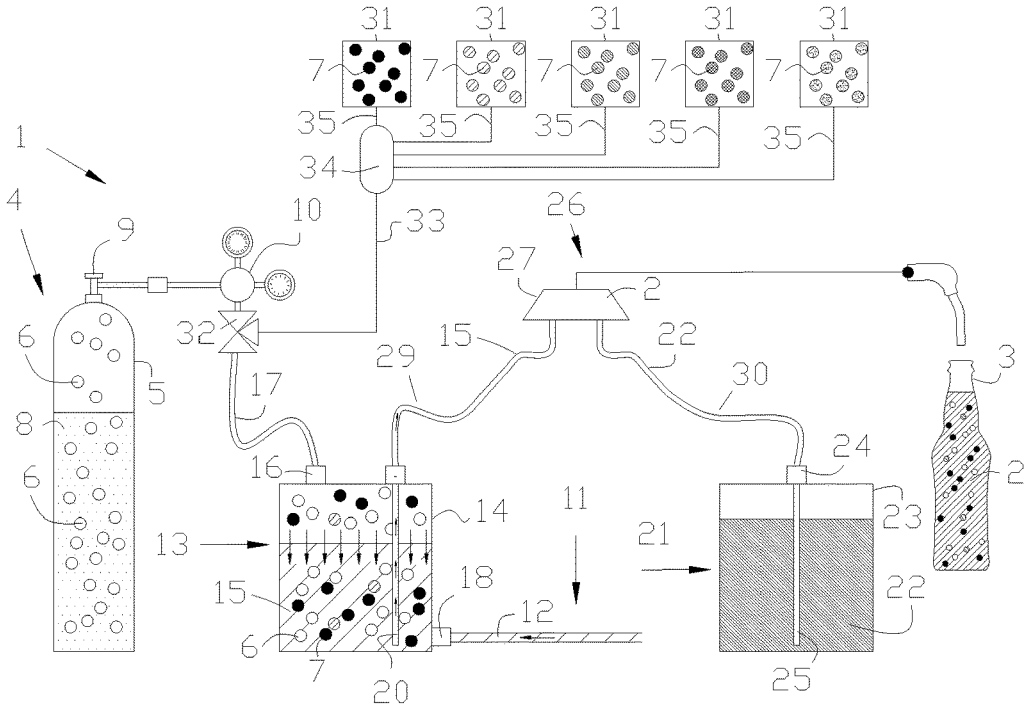

FIG. 3 illustrates a third embodiment of a device 1 in accordance with the invention in which the former is somewhat extended, by providing the device 1 with multiple flavor bottles 31 or flavor sources 31; each containing a different flavor 7.

The device 1 in this third embodiment is furthermore provided with a selector 34 which is connected to every flavor source 31, each time by a separate supply line 34.

The selector 34 can set the flavor source 31 which will be mixed with carbon dioxide and/or nitrogen in the mixing means 32.

This embodiment allows for creating a beverage 2 dispensed through tap line 28 comprising multiple flavors 7 or comprising a single different flavor 7 or a unique mix of flavors 7 each time a beverage 2 is dispensed, the flavor 7 or flavors 7 for example being chosen by a consumer.

Figure 4:
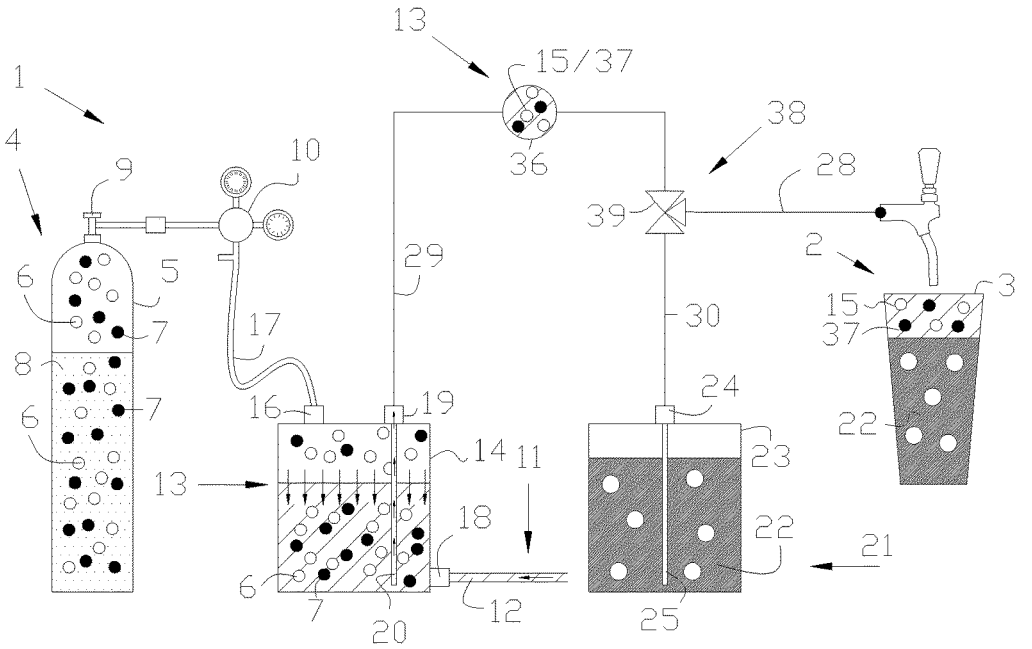

FIG. 4 illustrates still another embodiment of a device 1 in accordance with the invention.

A bottle 5 containing scented carbon dioxide and/or nitrogen 6-7 as in FIG. 1 is provided.

On the other hand supply line 11 is supplying in this case a flat beer 12 to the cask 14 for being carbonated with the scented carbon dioxide and/or nitrogen 6-7 by mixing.

The mixing means 13 comprise in this embodiment not only a cask 14 but also a foaming chamber 36 provided in the outlet line 29, so to form a first beverage component 22 being foam 37.

This foam 37 is therefore composed of a carbonated beer flavored with flavors 7.

The device of FIG. 4 furthermore comprises means 38, in this case a 3-way valve 39, for subsequently dispensing the second beverage component 22 and the first beverage component 15 or foam 37.

The second beverage component 22 is in this case a malt-based beverage 22 which is in this case dispensed without further mixing, directly in the glass 3.

Thereafter, the first beverage component 15 or foam 37 is added forming a foam collar 37 on top of the second beverage component 22.

Hereby, a layered beverage 2 is obtained, as is clearly illustrated in FIG. 4.

The present invention is by no means limited to a device 1 for dispensing a malt-based beverage according to the invention and a method according to the invention of dispensing a malt-based beverage, described as examples and illustrated in the drawings, but such a device 1 and such a method according to the invention can be realised in all kinds of variants, without departing from the scope of the invention.

The invention claimed is:

1. A method of dispensing a malt-based beverage into a receptacle ready for consumption and for use in an on-trade or off-trade environment, comprising the steps of:

composing a first component of the dispensed beverage during dispensing by mixing a liquid beer concentrate or flat beer concentrate with carbon dioxide and/or nitrogen in a first mixing chamber;

adding the first component, after the mixing in the first mixing chamber, to at least a second beverage component in a second mixing chamber separate from the first mixing chamber, the second beverage component comprising a diluent;

wherein said carbon dioxide and/or nitrogen is scented.

2. The method of dispensing a malt-based beverage according to claim 1, wherein the carbon dioxide and/or nitrogen is scented by a flavor comprising one or more of the following; a fermented hop flavour; a fruit flavour; a herb flavour; a spice flavour; a confectionery flavour.

3. The method of dispensing a malt-based beverage according to claim 1, wherein the receptacle is a glass, a can, or a bottle.

4. The method of dispensing a malt-based beverage according to claim 1, further comprising the steps of:

dispensing the liquid beverage in a receptacle so to provide the second component of the beverage;

adding subsequently a foam collar on top of said liquid beverage being the first component of the beverage, said foam collar created by mixing a scented carbon dioxide and/or scented nitrogen with a beer concentrate or a flat beer concentrate during foaming thereof.

5. A device for dispensing a malt-based beverage into a receptacle ready for consumption and for use in an on-trade or off-trade environment, wherein the device comprises at least:

a source of scented carbon dioxide and/or scented nitrogen;

a source of a liquid;

a first mixing chamber configured for mixing scented carbon dioxide and/or scented nitrogen supplied from the source of scented carbon dioxide and/or scented nitrogen, with a beer concentrate or a flat beer concentrate supplied from the source of liquid, into a first beverage component in the first mixing chamber;

a source of a second beverage component comprising a diluent;

a second mixing chamber configured for mixing the first beverage component with the second beverage component; and a dispensing device for dispensing the first beverage component and the second beverage component from the second mixing chamber into the receptacle so to form a dispensed malt-based beverage.

6. The device according to claim 5, further comprising:

a source of flavour;

a source of carbon dioxide and/or nitrogen; and a mixing device for mixing the flavour and the carbon dioxide and/or nitrogen supplied from the flavour and carbon dioxide and/or nitrogen sources; and wherein an output of the mixing device forms the source of scented carbon dioxide and/or scented nitrogen.

7. The device according to claim 6, wherein the mixing device is such that the first beverage component is formed with the first beverage component being foam.

8. The device according to claim 5, wherein the first mixing chamber is such that the first beverage component is formed with the first beverage component being foam.

9. A method of dispensing a malt-based beverage comprising the steps of:

providing a diluent;

providing a liquid which is a beer concentrate or a flat beer concentrate;

providing a source of a scented carbon dioxide and/or scented nitrogen;

treating said beer concentrate or said flat beer concentrate by guiding the scented carbon dioxide or scented nitrogen there through so to form a first component of the beverage in a first mixing chamber;

providing, separately from the first component, in a second mixing chamber separate from the first mixing chamber, a second beverage component comprising a diluent to the first component; and dispensing the first component and the second component from the second mixing chamber into a receptacle thereby obtaining a beverage ready for consumption.

* * * * *